US006132341A

United States Patent [19]

Lin

[11] Patent Number: 6,132,341

[45] Date of Patent: Oct. 17, 2000

[54] CYCLING EXERCISER HAVING A ROTATABLE HANDLE

[76] Inventor: Ting Fung Lin, 12F-1, No. 83, Suei Yuan Road, Taipei, Taiwan

[21] Appl. No.: 09/203,009

[22] Filed: Nov. 30, 1998

[51] Int. Cl.[7] ..... A63B 22/06

[52] U.S. Cl. ..... 482/57; 482/62; 482/63

[58] Field of Search ..... 482/57, 62, 63, 482/51, 79, 52

[56] References Cited

U.S. PATENT DOCUMENTS

| | | | |
|---|---|---|---|
| 4,563,001 | 1/1986 | Terauds | 272/72 |
| 5,314,392 | 5/1994 | Hawkins et al. | 482/57 |
| 5,545,111 | 8/1996 | Wang et al. | 482/53 |
| 5,645,512 | 7/1997 | Yu | 482/53 |
| 5,749,809 | 5/1998 | Lin | 482/52 |
| 5,888,176 | 3/1999 | Kuo | 482/53 |
| 5,924,961 | 7/1999 | Kuo et al. | 482/52 |
| 5,938,569 | 8/1999 | Lin | 482/52 |
| 5,980,431 | 11/1999 | Miller, Jr. | 482/57 |

*Primary Examiner*—Stephen R. Crow
*Assistant Examiner*—Tam Nguyen
*Attorney, Agent, or Firm*—Charles E. Baxley, Esq.

[57] ABSTRACT

A cycling exerciser includes a base having a seat post extended upward from the middle portion of the base. A pair of cranks are rotatably secured to the base at an axle for supporting a pair of foot pedals and for allowing the user to conduct cycling exercises. A handle is rotatably secured to the base and is coupled to the axle by unidirectional bearings and by a sprocket-and-chain device for allowing the handle to unidirectionally drive the axle and to rotate the cranks when the handle is rotated by the user. A spring member may be used for recovering the handle.

4 Claims, 3 Drawing Sheets

CYCLING EXERCISER HAVING A ROTATABLE HANDLE

BACKGROUND OF THE INVENTION

1. Field of the Invention

The present invention relates to an exerciser, and more particularly to a cycling exerciser having a rotatable handle.

2. Description of the Prior Art

Typical cycling exercisers comprise a pair of foot supports coupled to a support base by a pair of cranks and a handle solidly secured to the support base such that it does not rotate.

The present invention has arisen to mitigate and/or obviate the afore-described disadvantages of the conventional cycling exercisers.

SUMMARY OF THE INVENTION

The primary objective of the present invention is to provide a cycling exerciser having a handle that may be rotated by the user to facilitate the rotational movement of the foot supports.

In accordance with one aspect of the invention, there is provided a cycling exerciser comprising a base including a middle portion having a post extended upward therefrom for supporting a seat cushion, a pair of cranks rotatably secured to the base at an axle, a pair of foot pedals secured to the cranks respectively for allowing a user to conduct cycling exercises, a handle rotatably secured to the base, and means for unidirectionally driving the axle with the handle to rotate the cranks.

The unidirectional driving means includes a pair of rotary members disposed on the axle, a pair of unidirectional bearings disposed between the rotary members and the axle, and means for coupling the handle to the rotary members and to rotate the rotary members unidirectionally.

The rotary members are first sprockets, the handle includes a pole having a bottom portion and having a second sprocket secured on the bottom portion of the pole and rotated in concert with the pole, the coupling means includes a chain engaged around the second sprocket and engaged around the first sprockets, and means for recovering the pole of the handle.

The base includes a front portion having a sleeve secured thereon, the pole is rotatably secured in the sleeve. The recovering means includes a pulley secured to the bottom portion of the pole, and a resilient cable engaged around the pulley and secured to the chain for applying a resilient force against the chain.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
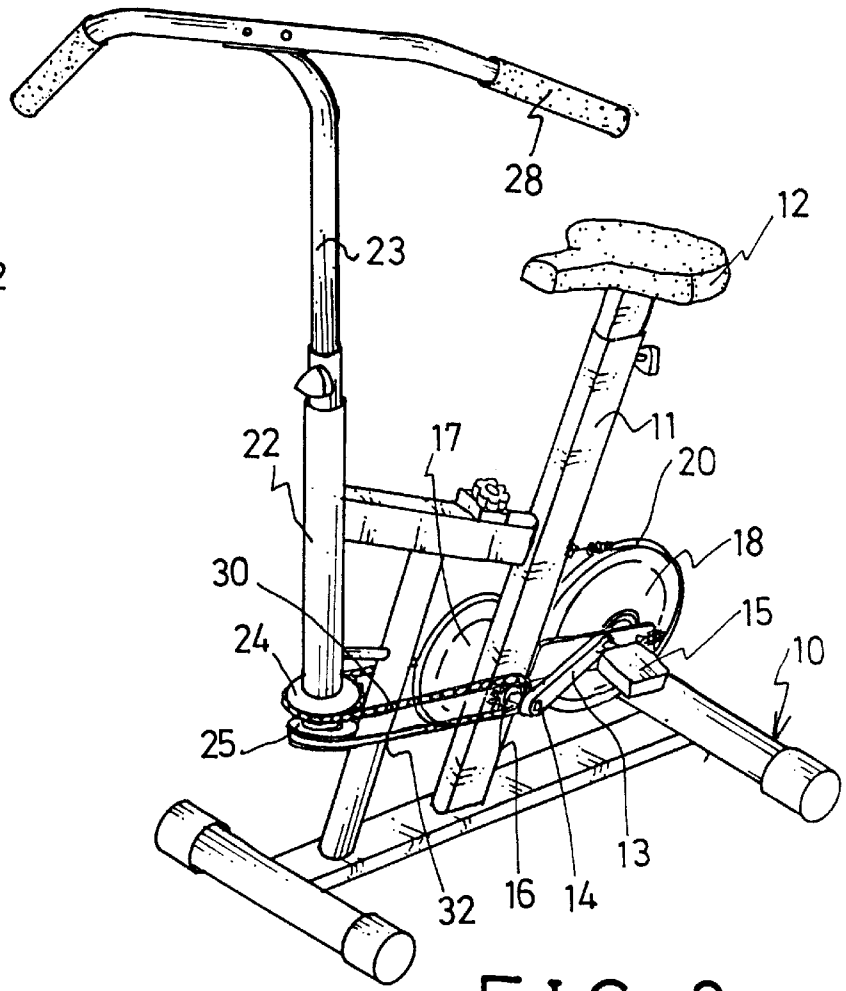
FIGS. 1 and 2 are front perspective views of a cycling exerciser in accordance with the present invention.
Figure 1:
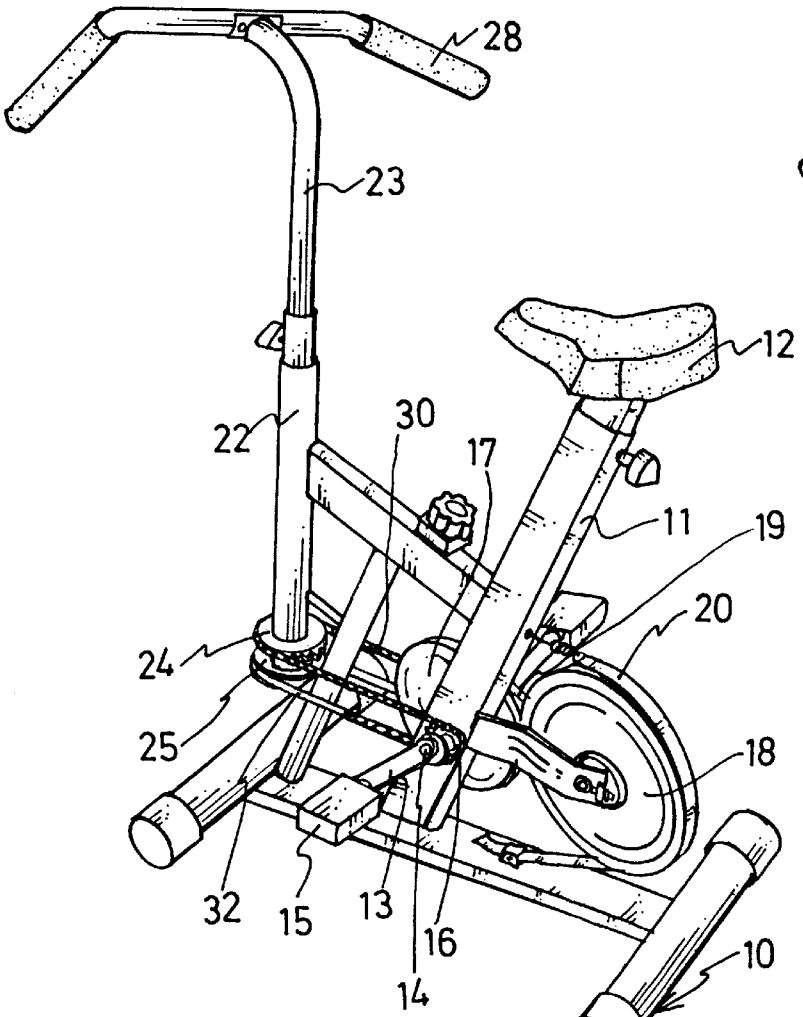
Figure 3:
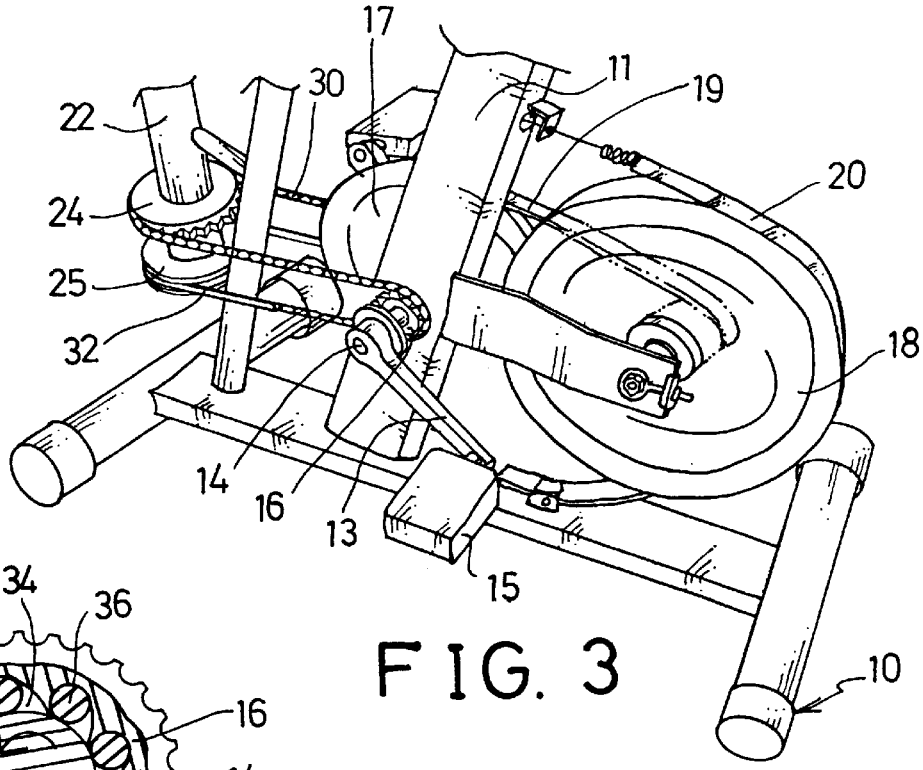
FIG. 3 is an enlarged partial perspective view of the cycling exerciser.

Referring to the drawings, and initially to FIGS. 1–3, a cycling exerciser in accordance with the present invention comprises a base 10 including a post 11 extended upward from the middle portion of the base 10 for adjustably supporting a seat cushion 12. A pair of cranks 13 are rotatably secured to the base 10 at an axle 14 for supporting foot pedals 15 and for allowing the user to conduct the cycling exercises with the foot pedals 15. A pair of rotary members, such as sprockets 16, are secured on the axle 14 and disposed on both sides of the post 11 close to the respective cranks 13; in which only one of the sprockets 16 is shown in the drawings. A wheel 17 is secured on the axle 14 and rotated in concert with the axle 14. A weight 18 is further rotatably secured to the base 10 and coupled to the wheel 17 for applying a resistive force against the rotational movement of the wheel 17 and the cranks 13. A belt 20 may be provided for allowing the user to brake the weight 18.

The base 10 includes a sleeve 22 secured to the front portion thereof for adjustably and rotatably supporting a pole 23 which is provided for supporting a handle 28. A sprocket 24 and a pulley 25 are secured to the bottom of the pole 23 and rotated in concert with the pole 23. A chain 30 is engaged around the third sprocket 24 and around the sprockets first and second 16. A resilient cable 32 is engaged around the pulley 25 and has two ends secured to the ends of the chain 30 for applying a resilient force against the chain 30.

Figure 4:
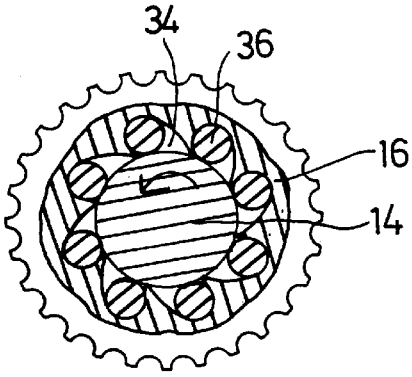
FIG. 4 is a cross sectional illustrating the unidirectional bearing for the sprocket.

As shown in FIG. 4, the sprockets 16 each includes a number of typical ratchet openings 34 formed therein for receiving balls or rollers 36 that are engaged between the axle 14 and the sprockets 16 for forming a unidirectional bearing or mechanism between the sprocket 16 and the axle 14. Or, two unidirectional bearings are disposed between the sprockets 16 and the axle 14 such that the axle 14 is rotatable unidirectionally relative to the sprockets 16 or, relatively, such that the sprockets 16 may be rotated unidirectionally relative to the axle 14. The unidirectional bearings 34, 36 provided between the sprockets 16 and the axle 14 are arranged such that the sprockets 16 will not be moved when the foot pedals 15 are moved in a continuous 360 degree circle as with the traditional cycling; i.e., the continuous 360 degree circle movement of the foot pedals 15 and the axle 14 will not be affected by the sprockets 16. Particularly, when the axle 14 is rotated forward by the foot pedals, the sprockets 16 will not be driven and rotated forward by the axle 14, and thus the handle 28 will not be rotated by the axle 14 via the sprockets 16 when the axle 14 is rotated by the foot pedals 15 to travel 360 degrees as a traditional exercise cycle. Because the sprockets 16 will not be rotated forward by the axle 14 when the axle 14 is rotated counterclockwise, relatively, the sprockets 16 may rotate freely rearward or backward relative to the axle 14, such that the rearward movement of the sprockets 16 will not drive and affect the rotation of the axle 14. It is to be noted that the sprockets 16 are arranged in different rotational directions relative to the axle 14 by the unidirectional bearings 34, 36 because the sprockets 16 are coupled together with the chain 30. For example, when the first sprocket 16 is rotated counterclockwise by rotating the handle 28, the second sprocket 16 will be rotated clockwise relative to the axle 14 by the handle 28 via the chain 30 such that the clockwise movement of the second sprocket 16 relative to the axle 14 will not affect the rotational movement of the axle 14. When the first sprocket 16 is rotated counterclockwise by the handle 28, the axle 14 is driven counterclockwise by the first sprocket 16 during the rotational movement of the axle 14. On the contrary, when the first sprocket 16 is rotated clockwise and freely relative to the axle 14, the second sprocket 16 may be used to drive the axle 14 forward. Accordingly, the axle 14 may be alternatively driven forward, step by step, by the sprockets 16 at any time during the rotational movement of the axle 14. is rotated by the foot pedals 15 to travel 360 degrees as the traditional exercise cycle, the sprockets 16 may, at any time, be rotated by the handle 28 to drive the axle 14 step by step in the reciprocating action and to accelerate the rotational movement of the axle 14.

In operation, the unidirectional bearings 34, 36 are arranged such that the sprockets 16 and the pole 23 will not be rotated by the axle 14 when the axle 14 is rotated by the user with the foot pedals 15. For example, as shown in FIG. 4, when the axle 14 is driven counterclockwise by the user, the sprockets 16 will not be driven by the axle 14. When the sprocket 24 is rotated by the handle 28 via the pole 23, the sprockets 16 rotated by the pole 23 via the chain 30 for driving the axle 14 counterclockwise and for facilitating the rotational movement of the axle 14. The resilient cable 32 acts as a biasing member for recovering the chain 30; i.e., the pole 23 may be rotated backward to the original release position by the cable 32 when the handle 28 is released.

Figure 7:
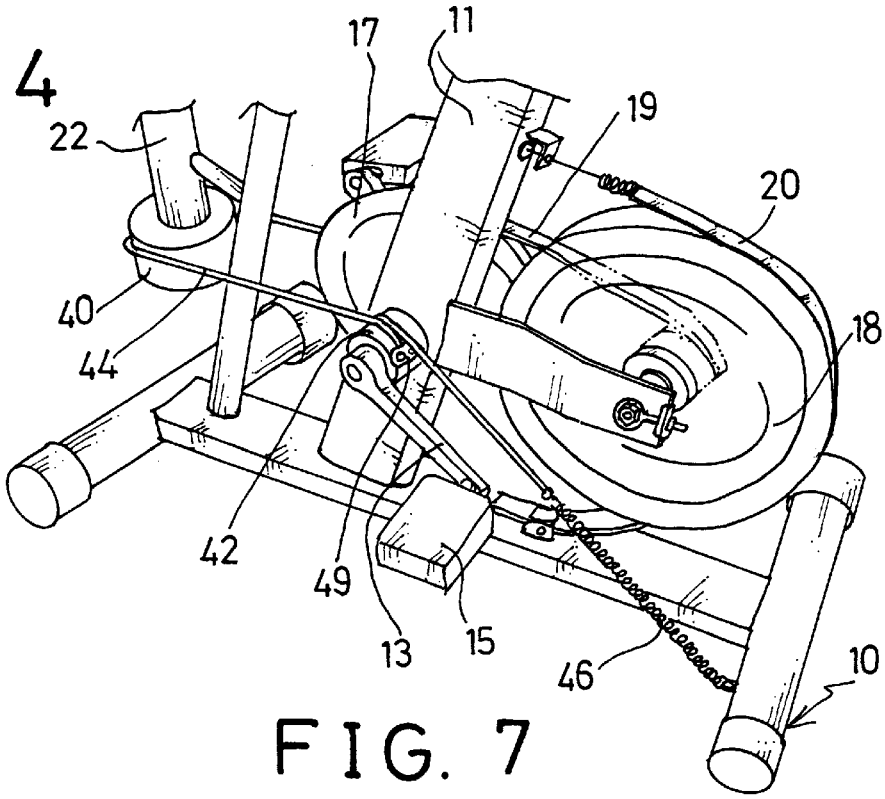
FIG. 7 is an enlarged partial perspective view of the cycling exerciser as shown in FIGS. 5 and 6.
Figure 6:
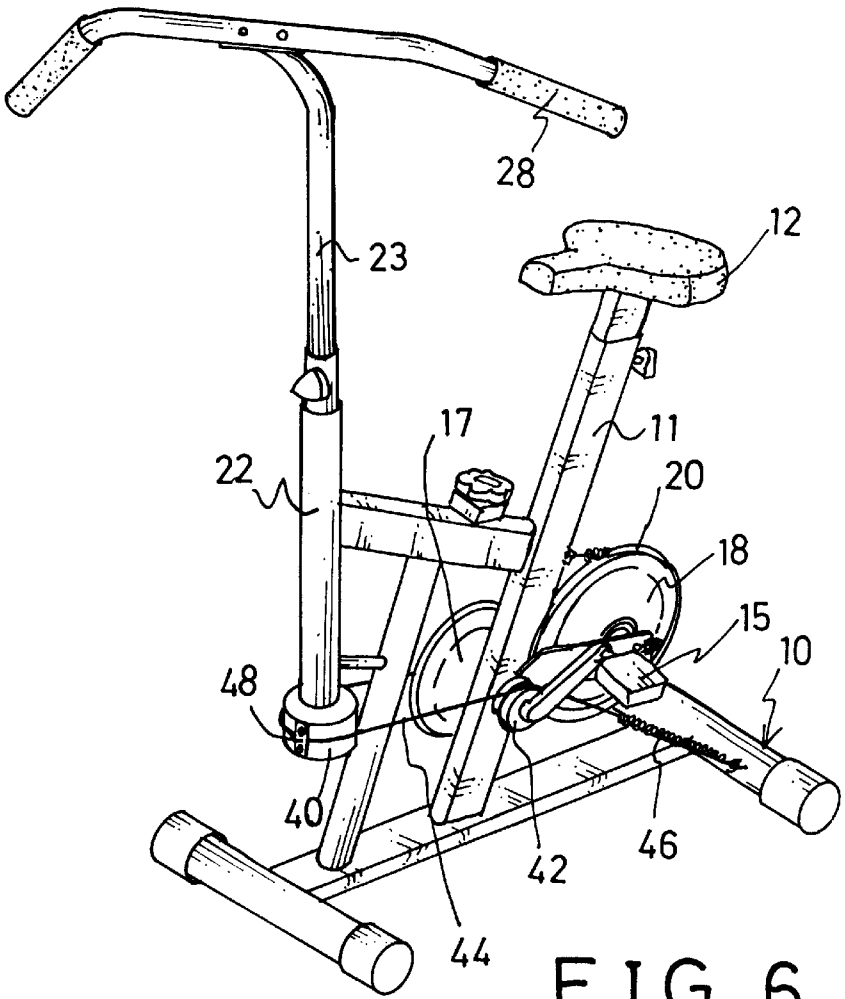
FIGS. 5 and 6 are front perspective views illustrating another application of the cycling exerciser in accordance with the present invention.
Figure 5:
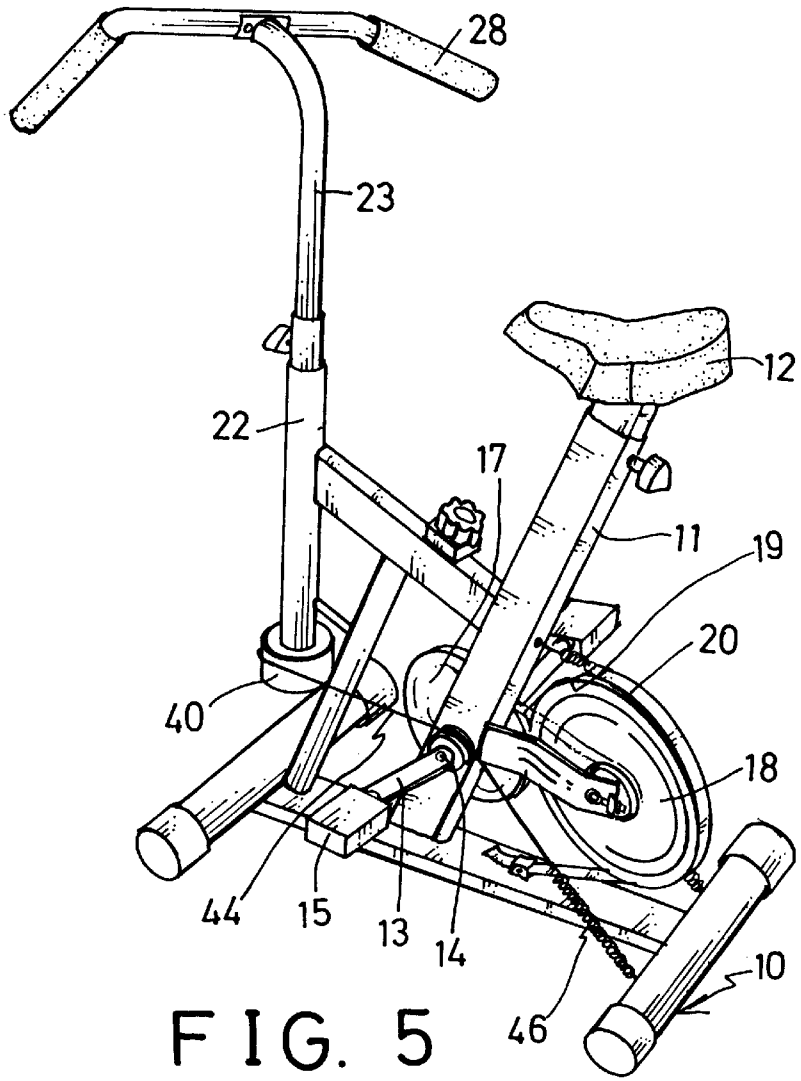

Referring next to FIGS. 5–7, similarly, the pole 23 includes an enlarged block 40 secured to the bottom. Two pulleys 42 are secured on the axle 14 instead of the sprockets 16 as shown in FIGS. 1–3. A resilient cable 44 has a middle portion secured to the block 40 by a fastener 48 and has two ends secured to the pulleys 42 by a fastener 49, such that the axle 14 may also be driven by the handle via the resilient cable 44. Two springs 46 may be coupled between the base 10 and the pulleys 42 for recovering the rotational movement of the block 40 and of the pole 23.

Accordingly, the cycling exerciser in accordance with the present invention includes a handle that may be rotated by the user to facilitate the rotational movement of the foot supports.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cycling exerciser comprising:

a base including a middle portion having a post extended upward therefrom for supporting a seat cushion, a pair of cranks rotatably secured to said base at an axle, a pair of foot pedals secured to said cranks respectively for allowing a user to conduct cycling exercises, a handle rotatable secured to said base, and means for unidirectionally driving said axle with said handle to rotate said cranks, wherein said unidirectional driving means includes a pair of rotary members disposed on said axle, a pair of unidirectional bearings disposed between said rotary members and said axle, and means for coupling said handle to said rotary members and to rotate said rotary members unidirectionally.

2. The cycling exerciser according to claim 1, wherein said rotary members are first and second sprockets, said handle includes a pole having a bottom portion and having a third sprocket secured on said bottom portion of said pole and rotated in concert with said pole, said coupling means includes a chain engaged around said second sprocket and engaged around said first and second sprockets, and means for recovering said pole of said handle.

3. The cycling exerciser according to claim 2, wherein said base includes a front portion having a sleeve secured thereon, said pole is rotatably secured in said sleeve.

4. The cycling exerciser according to claim 2, wherein said recovering means includes a pulley secured to said bottom portion of said pole, and a resilient cable engaged around said pulley and secured to said chain for applying a resilient force against said chain.

* * * * *